United States Patent [19]

Krause et al.

[11] 4,287,954

[45] Sep. 8, 1981

[54] SUBSURFACE SAFETY VALVE

[75] Inventors: William F. Krause; Edwin C. Turner, both of Houston, Tex.

[73] Assignee: Hydril Company, Los Angeles, Calif.

[21] Appl. No.: 68,077

[22] Filed: Aug. 20, 1979

[51] Int. Cl.[3] ..... E21B 43/12

[52] U.S. Cl. ..... 166/322; 251/52; 251/324

[58] Field of Search ..... 166/319, 332, 322, 318, 166/321; 251/58, 315, 324; 137/629

[56] References Cited

U.S. PATENT DOCUMENTS

| | | | |
|---|---|---|---|
| 2,780,290 | 2/1957 | Natho | 166/319 |
| 2,798,561 | 7/1957 | True | 166/321 |
| 3,189,044 | 6/1965 | Sizer | 166/322 |
| 3,958,633 | 5/1976 | Britch et al. | 166/321 |
| 4,009,753 | 3/1977 | McGill et al. | 166/319 |
| 4,103,744 | 8/1978 | Akkerman | 166/332 |
| 4,160,478 | 7/1979 | Calhoun et al. | 166/319 |

*Primary Examiner*—James A. Leppink

*Attorney, Agent, or Firm*—Pravel, Gambrell, Hewitt, Kirk, Kimball & Dodge

[57] ABSTRACT

A subsurface safety valve having a flapper-like pivoting closure element that is moved to and from the open and closed positions by a reciprocating operator assembly. When moved to the open position, the closure element is pivoted out of the flow path to protect it from possible damage.

2 Claims, 11 Drawing Figures

10a
16
10
H
B
42
40
18
10b
20
14
12
40
V
40b
40a
O
10c
46
20a
46
40
40d
20
44
40c
40e
48a
48
48c
48b
48d
22
24
3
20a
46
40d
20b
44
40e
40f
56
54
52
50
20c
48a
V
22
4
24

48d
48e
70c
24
48f
48
48g
48k
48a
48h
C
H
70a
48j
70
B
70b
3
26
28
48
48g
48k
O
60
V
C
66
32b
B
4
74
24
26
28
74
B
76
H
30
32a
32
V
76
B
32a

Fig. 3
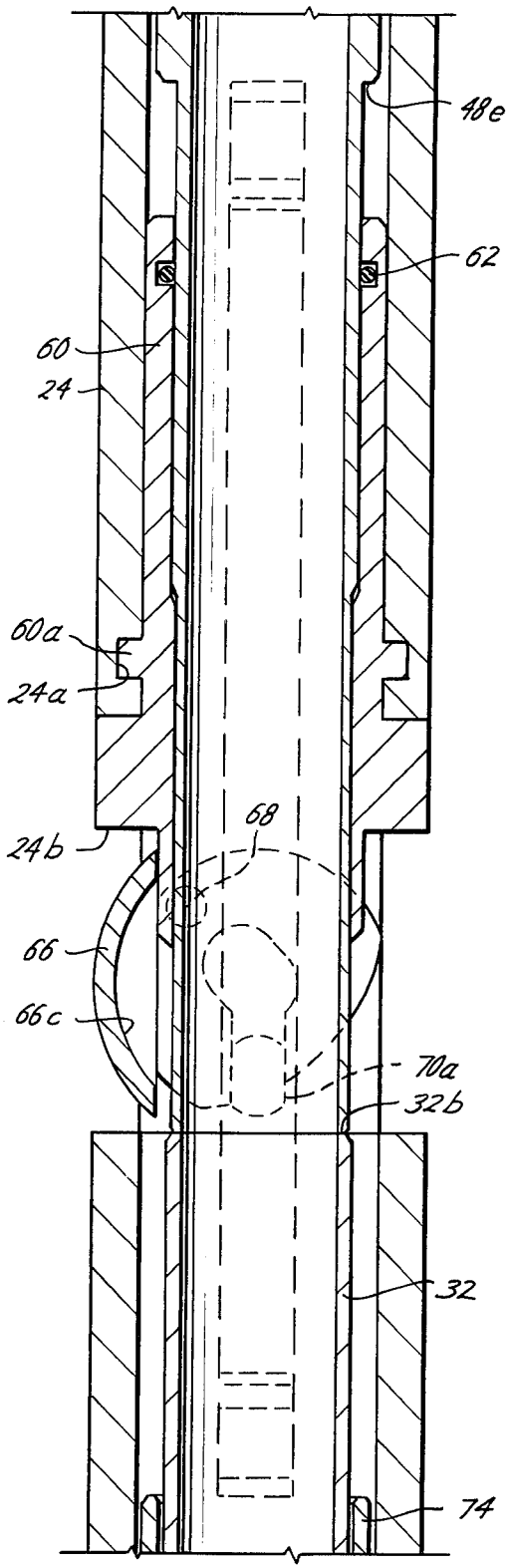
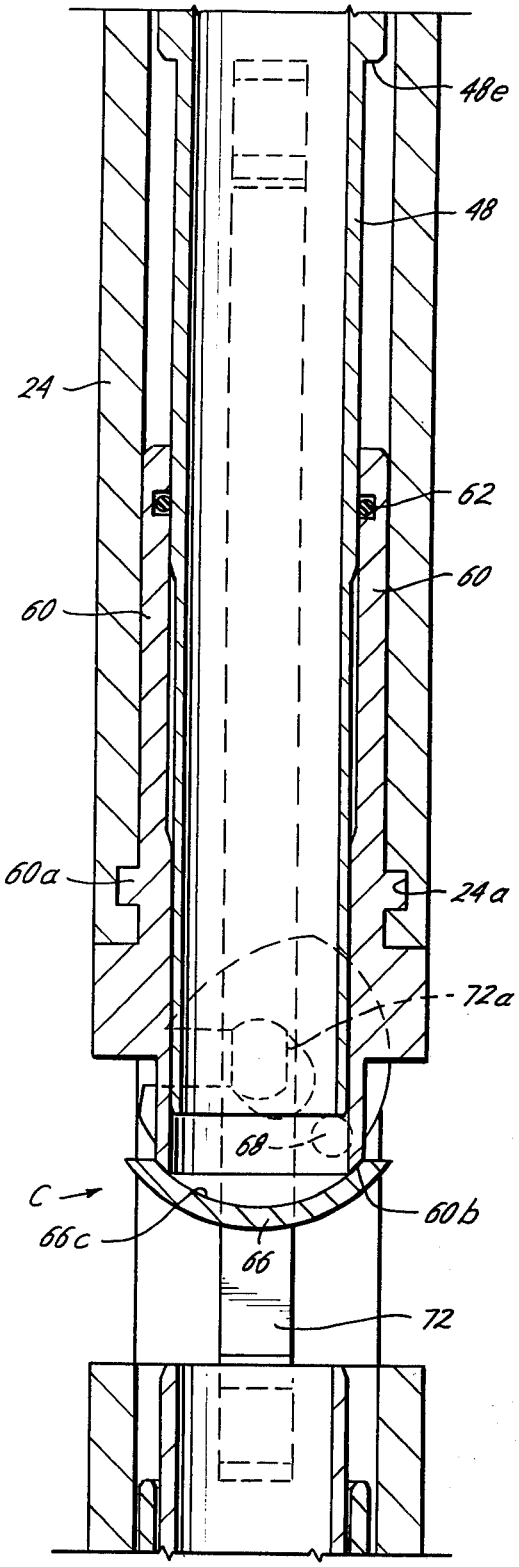
Fig. 4

SUBSURFACE SAFETY VALVE

DESCRIPTION

Technical Field

The present invention relates generally to subsurface safety valves for use in hydrocarbon producing wells and particularly to the positive operation closed of a flow protected closure element for such subsurface safety valves.

Background Art

In the production of hydrocarbon from wells a safety system employing a number of redundant valves are used to control the flow and prevent the well from blowing out. Such systems have numerous duplicative flow closures which are very expensive, but in view of the extent of possible damages to lives and property from a blowout such valve duplication is considered a wise practice. In offshore wells and some high pressure wells, a redundant well safety system is mandated by government authorities.

Such safety systems include surface or wellhead located safety valves that fail safe or close in response to a number of sensed conditions. Subsurface safety valves are located in the well production tubing below the wellhead and ground surface to prevent a blowout in the event of damage to the wellhead and surface controlled subsurface safety valves can also be made responsive to the sensed conditions.

Subsurface safety valves normally have a longitudinally reciprocating operator sleeve that is normally urged to the upper position by a spring for enabling fail-safe flow stoppage by the movable valve closure element. In the case of surface controlled subsurface safety valves, a pressure responsive surface on the operator exposed to a certain pressure of control fluid will move the operator down to effect movement of the closure element to the flow enabling position. Loss of such control fluid pressure for any reason will enable fail-safe closure of the valve.

Four types of valve closure elements—poppet, flapper, ball and sleeve—have been employed in subsurface safety valves. The poppet and sleeve type closure elements inherently preclude straight through flow in the valve and are subject to failure from erosion resulting from the entrained sand in the flow of produced hydrocarbons. In addition, they tend to overly restrict production flow rates. For these reasons, the poppet and sleeve type closure elements have not been as widely accepted as the other two types of closure elements.

The ball-type closure element provides a straight flow passage through the valve and which can be provided with a flow opening through the ball in the tubing retrievable version as large as the tubing bore such as disclosed in Mott U.S. Pat. No. 3,901,321; No. 3,993,136; and No. 3,744,564 or Knox U.S. Pat. No. 3,035,808. In wireline retrievable or through-the-flowline (TFL) subsurface valves the ball element may be made as large as the diameter of the bore of the production tubing to provide as large as possible flow opening as disclosed in Mott U.S. Pat. No. 4,067,387. A major reservation to the use of the ball-type closures has been the cost due to the expensive precision machining operations required when manufacturing the valve. See also Keithahn U.S. Pat. No. 2,998,077 for a partial ball element that is never moved fully out of the flow path to protect it from the flow.

While flapper-type closure elements are less expensive to manufacture and provide a straight through flow path, they also have a drawback. The flapper closure element was closed by operation of a small spring when the operator sleeve moved up as disclosed in Watkins U.S. Pat. No. 4,077,473 rather than being positively operated closed by the operator sleeve movement. Furthermore, this small spring was subject to fatigue failure in which event the valve would not close even though the operator had moved up. Due to the mechanical strength of the spring and the service stresses, expensive special materials were required for hydrogen sulfide service. Another advantage of the flapper-type valve is the sealing surface of the closure element and seat is located out of the flow path when in the open position where it is protected from entrained sand in the flow path.

DISCLOSURE OF THE INVENTION

In accordance with the present invention a subsurface well safety valve is provided with a closure element that is positively moved between the open and closed position. When moved to the closed position the closure element is also protected from the flow by the valve operator.

The present invention possesses the advantages of the positive operation of the ball-type closure element without the expensive cost of manufacture. In addition, it enjoys the advantage of a flapper-type closure element in being positioned outside the flow path when in the open position while not incurring the disadvantage of relying on the small closure spring. The invention is equally well suited for use in wireline or through-the-flowline (TFL) subsurface valves or in tubing retrievable subsurface valves.

BRIEF DESCRIPTION OF THE DRAWINGS

FIG. 3 is a view taken along line 3—3 of FIGS. 1B and 1C.

FIG. 4 is a view taken along line 4—4 of FIGS. 2B and 2C; and,

BEST MODE FOR CARRYING OUT THE INVENTION

Figures 1A, 1B, 2A, 2B:
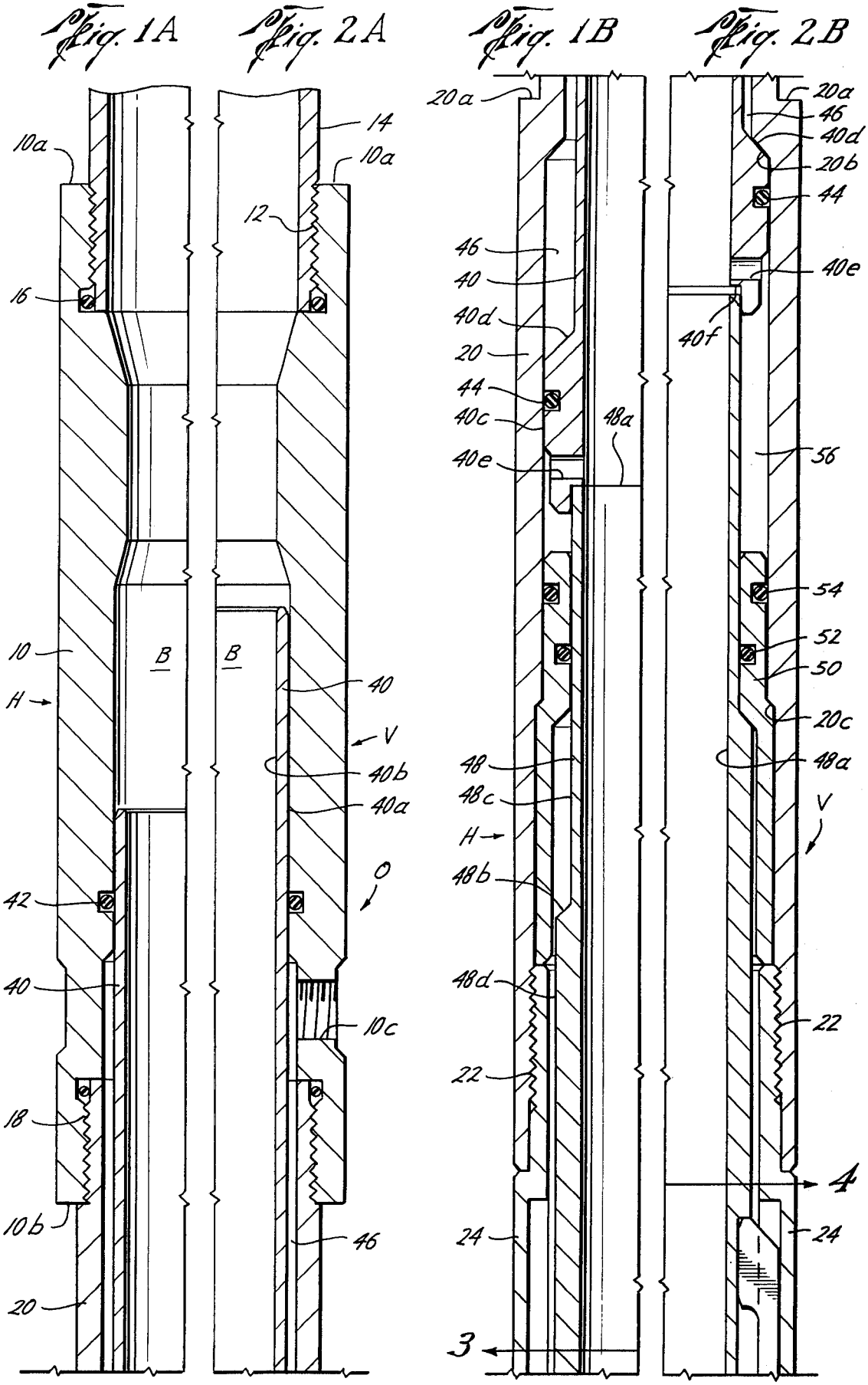
FIGS. 1A, 1B, 1C and 1D are side views in section of the subsurface safety valve of the present invention with the flow closure element in the open position.
FIGS. 2A, 2B, 2C and 2D are views similar to FIGS. 1A, 1B, 1C and 1D, respectively, with the closure element in the closed position.

Reference is made to FIGS. 1A-1D and 2A-2D where a wireline retrievable embodiment of the subsurface safety valve of the present invention is illustrated. However, it is to be understood that a tubing retrievable version, i.e. retrievable with the well tubing from the well, is equally well suited for use with the present invention. The safety valve, generally designated V is provided with a tubular valve housing, generally designated H, that is releasably secured in a polished bore of a landing nipple (not illustrated) connected in the well tubing (not illustrated) in the usual manner.

For purposes of assembly, the tubular valve housing H is formed of a number of threaded sleeves secured together to form the valve housing H. As illustrated in FIG. 1, the tubular valve housing has an upper sleeve 10 having threads 12 formed thereon for attachment to a suitable releasable securing means 14 for securing in the polished bore. The releasable securing means may be of any well-known type that is commercially available. For example, an Otis Type X locking mandrel that is received in a corresponding ported landing nipple such as described at page 4526 of the 1976–77 issue of the *Composite Catalog of Oilfield Equipment and Services* may be employed. An O-ring 16 prevents leakage of fluid along the threads 12 for preventing leakage of fluid between the releasable lock mandrel 14 and the upper housing sleeve 10.

The upper sleeve 10 forms an upwardly facing annular shoulder 10*a* and a downwardly facing annular shoulder 10*b* and adjacent the downwardly facing annular shoulder 10*b* is formed threads 18 for securing with an upper intermediate housing sleeve 20. As illustrated in FIG. 1B, the upper intermediate housing sleeve forms an upwardly facing annular shoulder 20*a* with Chevron packing (not illustrated) mounted about the housing sleeve 20 between the annular shoulders 10*b* and 20*a* for effecting a fluid tight seal between the tubular valve housing 10 and the inner polished surface of the bore of the landing nipple as is well known to those skilled in the art. The shoulder 10*a* of the upper housing sleeve cooperates with the releasable securing mandrel 14 for forming a second fluid tight seal with the landing nipple in a similar manner. A threaded port 10*c* enables control fluid communication through the housing H between the chevron packing that is isolated from the well fluid for a purpose to be described later.

Figures 1C, 1D, 2C, 2D:
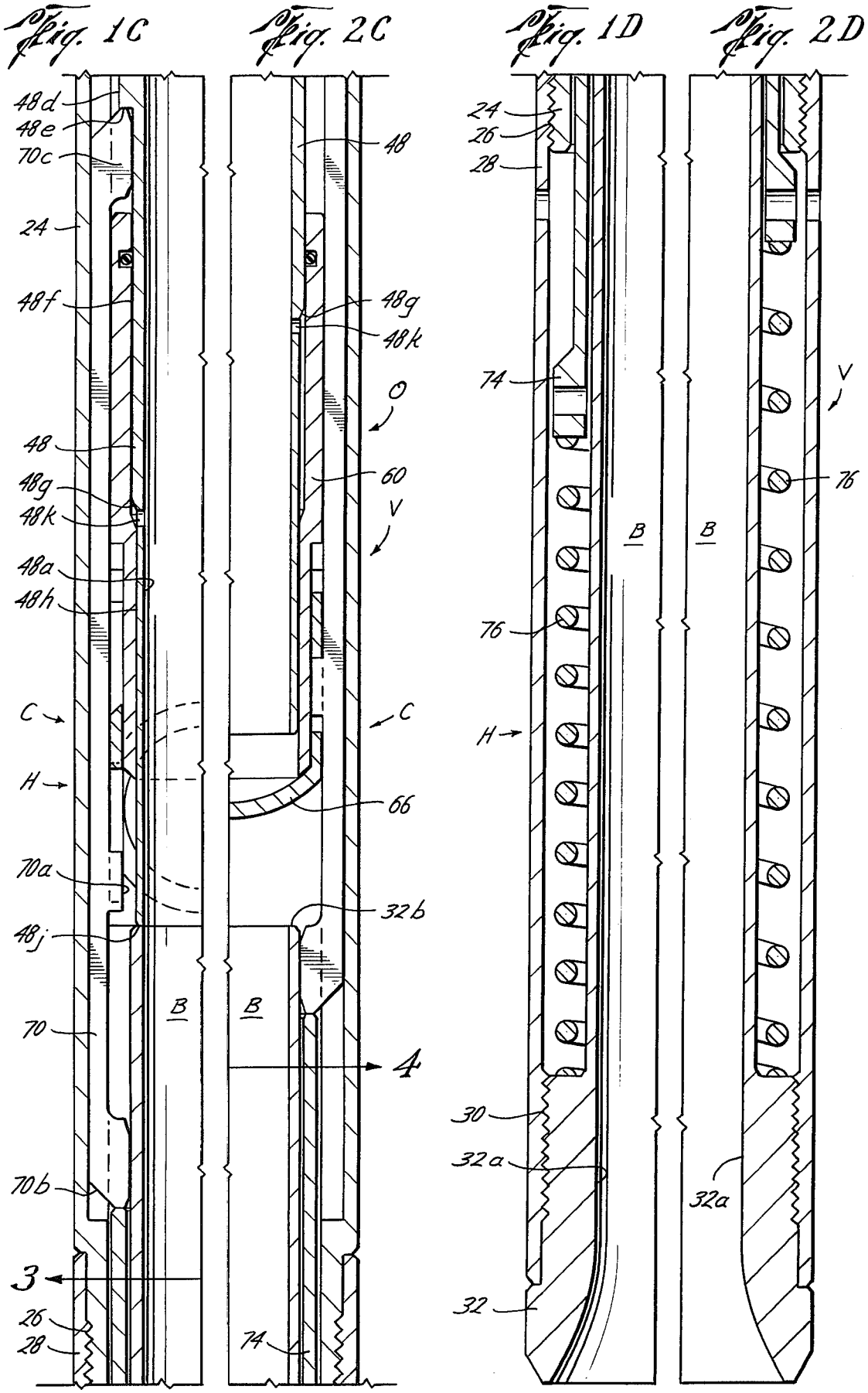

As illustrated in FIG. 1B, the upper intermediate tubular housing sleeve 20 is secured by threaded engagement at 22 with a lower intermediate housing sleeve 24. The tubular housing sleeve 24 threadably engages at 26 (FIG. 1C) with the lower tubular housing sleeve 28. Secured to the lower housing sleeve by threaded engagement at 30 is a flow inlet sleeve 32 having an inner surface 32*a* forming a flow passage for fluids to flow upwardly through the bore B of the tubular housing H. The inlet sleeve 32 extends upwardly within the bore B of the housing H to form an upwardly facing annular shoulder 32*b* (FIG. 2C).

Disposed within the bore B of the valve housing H are a bore closure means, generally designated C, and an operator means O for moving the bore closure means C to and from a first or closed position (FIG. 2C) blocking flow of fluid through said bore B and a second or open position (FIG. 1C) for enabling flow of the fluid through the bore B.

The operator means O includes an upper operator sleeve which is movably mounted in the bore B of the housing H. The operator sleeve is longitudinally movable between a lower position (FIGS. 1A, 1B, 1C) opening the bore closure means C and an upper position closing the bore B closure means C which is illustrated in FIGS. 2A, 2B, and 2C. The tubular operator 40 has an outer surface 40*a* and an inner surface 40*b* for defining a flow path for the fluid through the valve V. The outer surface 40*a* is sealed to the upper housing member 10 by O-ring 42 while enabling the longitudinal reciprocating movement of the operator sleeve 40. As best illustrated in FIG. 1B, the sleeve 40 is provided with an outwardly projecting collar 40*c* mounting an O-ring 44 for slidably sealing with the upper intermediate sleeve 20. The location of the O-rings 44 and 42 provide a pressure responsive upwardly facing annular shoulder 40*d* exposed to an expansible chamber 46 for enabling urging of the control fluid communicated through port 10*c* on the operator sleeve 40. Increased control fluid pressure communicated from the landing nipple port between the chevron seals through port 10*c* into the chamber 46 will urge on the shoulder 40*d* for urging the operator 40 to move downwardly, which as will be explained in detail hereinafter, will effect opening of the bore closure means C. When the pressure in the expansible chamber 46 is below a certain value, the operator sleeve 40 will move upwardly as will be explained until the shoulder 40*d* partially engages a downwardly facing annular shoulder 20*b* formed by the upper intermediate housing sleeve 20.

Below the O-ring 44 a flow port 40*e* is provided for permitting ingress and egress of well fluids from the area below the seal 44.

Operably associated with the operator sleeve 40 is a flow tube 48 that is also disposed in the bore B for reciprocal movement with the operator sleeve 40. The flow tube 48 is provided with an upwardly facing annular shoulder 48*a* which engages a corresponding downwardly facing shoulder 40*f* of the operator sleeve 40 for imparting the downward reciprocating movement from the operator 40 to the flow tube 48. The flow tube 48 is provided with an inner surface 48*a* which defines a flow passage through the bore B of the valve V in the usual manner. As illustrated in FIG. 1B, an upwardly facing annular shoulder 48*b* separates the outer surface into a surface of upper smaller diameter 48*c* and a lower surface of larger diameter 48*d*. A stationary tubular seal member 50 carries an O-ring 52 for effecting a seal with the surface 48*a* for blocking leakage of fluid between the movable flow tube 48 and the seal member 50. An O-ring 54 also carried by the seal member 50 effects a fluid seal to block leakage of fluid between the seal member 50 and upper intermediate housing member 20. Make-up of the threaded engagement 22 engages the seal member 50 with the housing member 24 for preventing downward movement of the seal member 50 while annular shoulder 20*c* formed by the upper intermediate housing member 20 prevents upward movement of the seal member 50.

The seals effected by the O-rings 52 and 54 and that of the O-ring 44 on the operator sleeve 40 define an expansible chamber 56 which is vented through port 40*e* to the bore B as the flow tube 48 moves down. As illustrated in FIG. 1C, the outer surface 48*d* of the flow tube 48 terminates at a downwardly facing annular shoulder 48*e* which connects with a smaller diameter surface 48*f* of the flow tube. The surface 48*f* is provided with the tapered annular shoulder 48*g* leading to an even smaller diameter surface portion 48*h* that terminates at downwardly facing annular shoulder 48*j*. When the flow tube 48 is in the lower position, the shoulder 48*j* engages the shoulder 32*b* for providing a smooth flow path through the valve V. A port 48*k* located adjacent the shoulder 48*g* enables ingress and egress of fluid therethrough during reciprocal movement of the flow tube 48.

Figure 5:
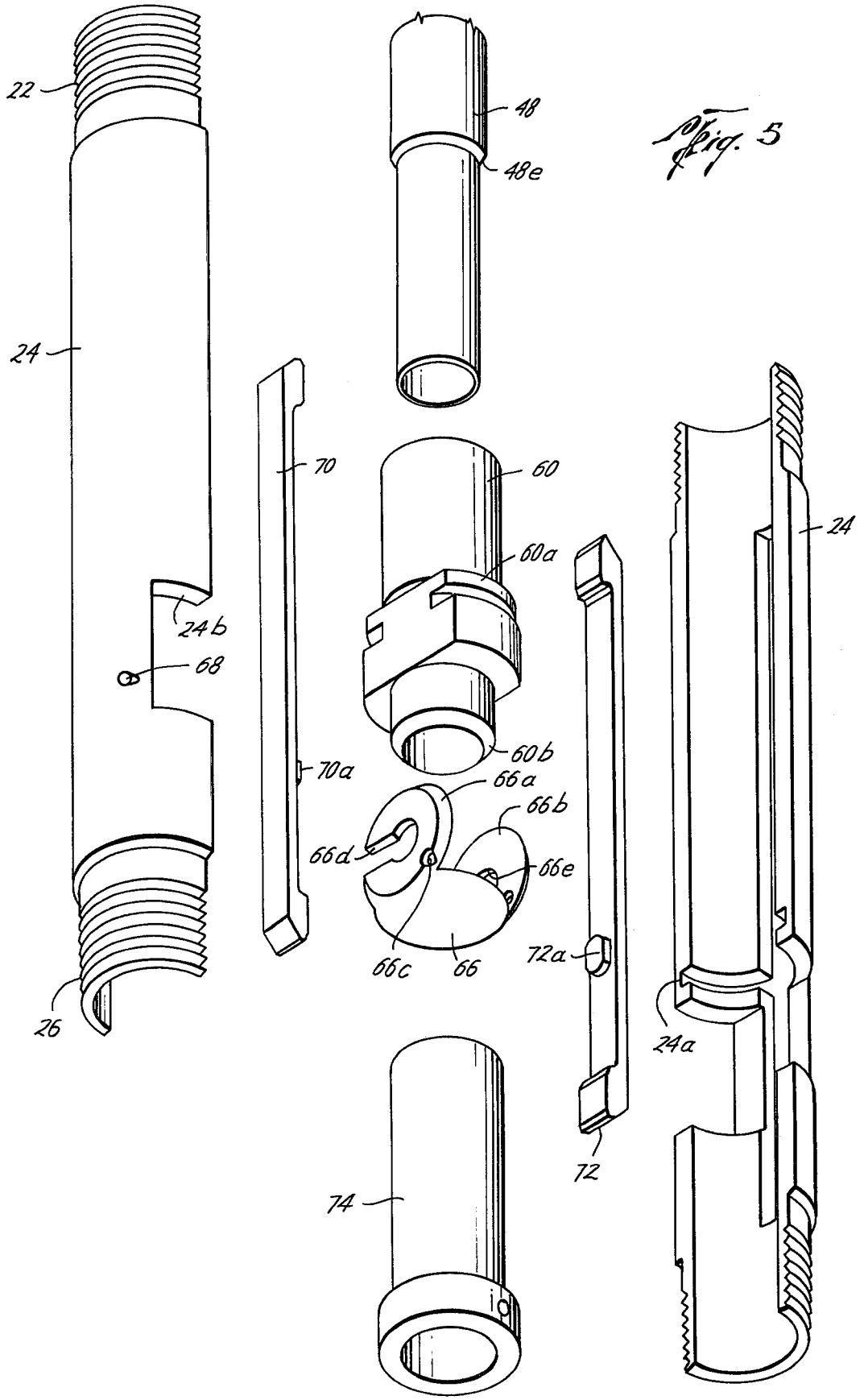
FIG. 5 is an exploded view of the valve closure element and a portion of the valve operator for illustrating the assembly.

Concentrically mounted exteriorly of the flow tube 48 and within the bore B is a seat ring 60 that is secured to the housing sleeve 24. The longitudinally bisected housing sleeve 24 (FIG. 5) is provided with an annular slot 24*a* for receiving a partial collar 60*a* formed on seat 60. The securing of the seat 60 with the housing sleeve 24 by such arrangement is also illustrated in detail in FIGS. 3 and 4. The seat 60 carries an O-ring 62 for sealing with the surface 48*f* of the flow tube 48 in the usual manner. As best illustrated in FIG. 4, the lower annular arcuate sealing surface 60*b* of the seat 60 seals with the bore closure means C when in the closed position for blocking the flow of fluid through the bore B of the valve V.

The bore closure means C is provided by a flapper-like closure element 66 having a pair of parallel operating flanges 66*a* and 66*b* secured at right angles thereto. Disposed between the flanges 66*a* and 66*b* is a curved inner sealing surface 66*c* for sealing with the corresponding sealing surface 60*b* of the seat 60 when in the closed position (FIG. 4). The flanges 66*a* and 66*b* are disposed upon opposite sides of the closure element 66 and effect positive operation of the closure element 66 to and from the open and closed position. The closure element 66 is pivotally connected to the housing sleeve 24 by concentric pins 68 which are received in corresponding slots 66*c* formed on the flange 66*a*. As the illustrated embodiment is the wireline retrievable type valve and it is desirable to have the flow passage as large as possible, windows 24*a* and 24*b* are formed in the tubular housing 24 to enable the closure element 66 to pivot about pins 68 to the open position as illustrated in FIG. 3. While only one window is required to receive the closure element 66, the windows 24*a* and 24*b* enable the closure element 66 to move out of the flow path for the flow tube 48 to move downwardly sufficiently to engage the shoulder 32*b* of the inlet sleeve 32 to isolate and protect the closure element 66 from the flow of fluid when in the open position.

Each of the flanges 66*a* and 66*b* of the closure element 66 are provided with an operating groove or slot 66*d* and 66*e*, respectively. Received within the slot 66*d* and 66*e* are pins 70*a* and 72*a* which are formed on the operating links or fingers 70 and 72. The fingers 70 and 72 are disposed upon opposite sides of the closure element 66 for engagement therewith. As illustrated in FIG. 1C, the link 70 has an enlarged lower end 70*b* as well as an enlarged upper end 70*c* as does link 72. The enlarged upper ends 70*c* and 72*c* engage the shoulder 48*e* of the flow tube for moving the links 70 and 72 downwardly and which movement will effect pivoting of the closure element 66 about the pivot pins 68 from the closed position to the open position. The lower ends 70*b* and 72*b* engage a movable spring follower 72 that is biased upwardly by the urging of a spring 76 which is held in position by the inlet tube 32 of the valve housing H. The urging of spring 76 through the tubular follower 74 urges the links 70 and 72 upwardly for normally urging the element 66 to the closed position. Such urging is transmitted through the fingers 70 and 72 to the closure element 66 and on to the flow tube 48 and the operator sleeve 40.

USE AND OPERATION OF THE PRESENT INVENTION

In the use and operation of the present invention, the valve is assembled in the manner illustrated. At this point the urging of spring 76 will maintain the spring follower 74, the links 70 and 72, the flow tube 48 and operator sleeve 40 in the upper position with the closure member 66 in the closed position as illustrated in FIGS. 2A–2D. When desired the valve may then be installed in a well using a wireline lubricator with methods that are well known in the art. When the valve is run through the bore of the well tubing to the subsurface location in the landing nipple, it is releasably secured therein by wireline operations. The exterior annular straddle packing seals with the polished bore above and below the landing nipple port. When it is desired to open the valve, increased control fluid pressure is applied to the landing nipple in the usual and known manner. This control fluid pressure is communicated by the landing nipple port to a location between the chevron straddle packing where it passes through the port 10*c* into the expansible chamber 46. The increased fluid pressure will there urge on the upwardly facing annular shoulder 40*d* of the operator. As the pressure is increased in the expansible chamber 46 the operator 40 moves downwardly for moving the flow tube 48, the operating links 70 and 72, and the spring follower 40 downwardly by compressing the spring 76. As the operating links 70 and 72 move downwardly the pins 70*a* and 72*a* received within the slots 66*d* and 66*e* will move the closure element 66 to pivot about the axis provided by the fixed pivot pin 68. As the closure element 66 positively moves to the open position by the engagement with the pivot pins 70*a* and 72*a* it will move into the window 24*b* formed by the tubular housing 24. As the closure element pivots into this position illustrated in FIG. 3 the flow tube 48 will move downwardly through the seat 60 until it engages upwardly facing annular shoulder 32*b* of the housing inlet member 32. When the assembly of the operator sleeve 40, flow tube 48, links 70 and 72 and spring follower 74 have moved downwardly, the operating pins 70*a* and 72*a* will have moved the closure element 66 to the open position as illustrated in FIGS. 1A, 1B, 1C, 1D and 3 by moving through the slots 66*d* and 66*e*, respectively.

When it is desired to close the valve V, the control fluid pressure is reduced at the surface. This enables the urging of the spring 76 to overcome the urging on the pressure responsive surface 40*d* of the operator member 40 and moves the operating assembly upwardly for positively moving the flow closure element 66 back to the closed position. In moving to the closed position, the operating pins 70*a* and 72*a* will assure that the closure element will move back to the closed position by moving upwardly in their respective slots for pivoting the closure element 66 around the fixed pivot pins 68.

The foregoing disclosure and description of the invention are illustrative and explanatory thereof, and various changes in the size, shape and materials as well as in the details of the illustrated construction may be made without departing from the spirit of the invention.

We claim:

1. A subsurface well safety valve for use in a well flow conductor, including:

a tubular valve housing having means for securing in a well flow conductor at a subsurface location in a well, said housing having a bore formed therethrough in flow communication with the flow conductor for enabling production of hydrocarbons from the well;

a flow closure element disposed in said bore for movement to and from a first position blocking flow of fluid through said bore and a second position enabling flow through said bore;

operator means disposed in said bore for moving said flow closure element to and from the first and second positions, said operator means having a pressure responsive surface exposed to a control fluid for moving said flow closure element to the second position in response to the application of control fluid pressure to said pressure responsive surface;

urging means mounted with said tubular housing for urging said operator means to move said closure element to the first position for blocking flow of fluid through said bore;

said closure element pivotally connected to said tubular valve housing for rotation about said pivotal connection to and from the first position and second position;

said closure element operably connected to said operator means for pivoting said closure element about said pivotal connection in response to movement of said operator means;

seat means fixed in said bore and sealingly engageable with said closure means in the first position for blocking flow of fluid through said bore;

said closure element in the second position pivoted outwardly of said seat means to enable said operator means to isolate said flow closure element from the flow of fluids wherein said closure element is protected when in the second position enabling flow of fluid through said bore; and said operator means includes a tubular assembly reciprocally movable within said bore, said tubular assembly having a flow tube for isolating said closure element in the second position from the flow of well fluids.

2. A subsurface safety valve for use in a well flow conductor, including:

a tubular valve housing having means for securing in a well flow conductor at a substrate location in a well, said housing having a bore formed therethrough in flow communication with the flow conductor for enabling production of hydrocarbons from the well;

a flow closure element disposed in said bore for movement to and from a first position blocking flow of fluid through said bore and a second position enabling flow through said bore, said closure element pivotally connected to said tubular valve housing for rotation about said pivotal connection to and from the first position and second position;

operator means movably disposed in said bore for moving said flow closure element to and from the first and second positions, said operator means including a tubular assembly reciprocally movable within said bore, said tubular assembly having a flow tube for isolating said closure element in the second position from the flow of well fluids;

urging means mounted with said tubular housing for urging said operator means to move said closure element to the first position for blocking flow of fluid through said bore;

said closure element operably connected to said operator means for pivoting said closure element about said pivotal connection in response to movement of said operator means;

seat means fixed in said bore and sealingly engageable with said closure means in the first position for blocking flow of fluid through said bore; and said closure element in the second position pivoted outwardly of said seat means to enable said operator means to isolate said flow closure element from the flow of fluids wherein said closure element is protected when in the second position enabling flow of fluid through said bore.

* * * * *